US005310031A

United States Patent [19]

Plath

[11] Patent Number: 5,310,031

[45] Date of Patent: May 10, 1994

[54] HARD SIDED LUGGAGE WITH SOFT COVERED EXTERNALLY ACCESSIBLE POUCH AREAS

[76] Inventor: Robert V. Plath, 3030 NE. 44th St., Lighthouse Point, Fla. 33064

[21] Appl. No.: 859,151

[22] Filed: Mar. 27, 1992

[51] Int. Cl.[5] ..... A45C 5/14; A45C 13/00

[52] U.S. Cl. ..... 190/18 A; 190/111

[58] Field of Search ..... 190/109-112, 190/18 A, 102, 108, 903, 113; 150/113, 117

[56] References Cited

U.S. PATENT DOCUMENTS

| | | | |
|---|---|---|---|
| Re. 25,826 | 8/1965 | Ward | 190/108 |
| 1,367,574 | 2/1921 | White | 190/111 |
| 1,495,046 | 5/1924 | Spiegel | 190/111 |
| 1,647,551 | 11/1927 | St. Lawrence | 190/111 |
| 2,055,569 | 9/1936 | Zolotow | 150/113 |
| 2,180,191 | 11/1939 | Bauch | 190/111 |
| 2,294,794 | 9/1942 | Morelli | 190/111 |
| 2,331,428 | 10/1943 | Selezneff | 190/111 X |
| 2,496,128 | 1/1950 | Lifton | 190/111 |
| 2,552,438 | 5/1951 | Kramer | 190/111 |
| 2,561,888 | 7/1951 | Ruge | 190/903 X |
| 2,562,499 | 7/1951 | Lifton | 190/111 X |
| 2,705,063 | 3/1955 | Torrent | 190/111 |
| 2,851,076 | 9/1958 | Stakofsky | 150/119 X |
| 3,147,788 | 9/1964 | Pinnola | 150/117 X |
| 3,291,266 | 12/1966 | Komroff | 190/113 X |
| 3,388,777 | 6/1968 | Nolan | 190/109 |
| 3,410,376 | 11/1968 | Benzel | 190/109 |
| 3,447,649 | 6/1969 | Kish, Jr. | 190/111 |
| 3,759,356 | 9/1973 | Bostick et al. | 190/111 |
| 4,139,084 | 2/1979 | Linke | 190/111 X |
| 4,156,480 | 5/1979 | Darbonnier | 190/111 |
| 4,199,826 | 4/1980 | Devereux | 190/111 X |
| 4,483,427 | 11/1984 | Gerch | 190/112 X |
| 4,729,460 | 3/1988 | Kim | 190/109 |
| 4,738,342 | 4/1988 | Boitani | 190/111 |
| 4,890,705 | 1/1990 | Pineda | 190/109 X |
| 4,938,326 | 7/1990 | Pfeiffer | 190/109 |
| 4,995,487 | 2/1991 | Plath | 190/18 A |
| 5,060,767 | 10/1991 | Pulichino, Jr. et al. | 190/111 |

FOREIGN PATENT DOCUMENTS

| | | | |
|---|---|---|---|
| 2506780 | 2/1976 | Fed. Rep. of Germany | 190/111 |
| 2371899 | 7/1978 | France | 190/111 |
| 2436705 | 5/1980 | France | 190/111 |
| 2480579 | 10/1981 | France | 190/111 |
| 459489 | 3/1951 | Italy | 190/111 |
| 471609 | 2/1953 | Italy | 190/111 |
| 105045 | 3/1917 | United Kingdom | 190/111 |

*Primary Examiner*—Sue A. Weaver
*Attorney, Agent, or Firm*—Jones & Askew

[57] ABSTRACT

A hard sided clamshell suitcase with integrally formed wells in top and bottom side panels is disclosed. The wells include a well periphery having a peripheral shelf upon which a reinforced periphery of a pouch is seated, the pouch being secured to standoff regions within the interior of the well. A wall defining a raised structure with a well floor that is co-planar with the side panel has an upper surface of the wall co-planar with a wheel base plane to provide a stable plane of rest for a suitcase when laid on its bottom. The well in the top side panel is recessed and has a soft cover that is co-planar with the side panel.

47 Claims, 6 Drawing Sheets

HARD SIDED LUGGAGE WITH SOFT COVERED EXTERNALLY ACCESSIBLE POUCH AREAS

TECHNICAL FIELD

The present invention relates to the art of luggage and in particular to both the areas of multi-compartment luggage with externally accessible compartments and luggage particularly designed and sized to be carried into and stowed within the passenger compartment of a commercial passenger airplane.

BACKGROUND OF THE INVENTION

In recent decades, commercial airlines have become the principal mode of business travel in the United States and an important mode of business travel in many other industrialized countries of the world. Flight crews and business men and women often travel to distant cities for short periods of time. On such trips, they have a need to carry at least one change of clothing and some toilet articles, but do not require a great deal of luggage capacity.

As the use of commercial air travel has expanded, many passengers, as well as flight crews, have developed a strong preference for "carrying on" their luggage rather than checking same through the airline's baggage checking and claim system. Carry on luggage refers to luggage of the passenger that is carried into the passenger compartment for stowage either under a seat or in an overhead storage compartment. Checked baggage is tagged with a unique identifier and a receipt is given to the passenger. The baggage is then handled by personnel of the airline and, if all the sorting and routing goes well, is stowed in a baggage hold in the aircraft. At each stop, bags designated for removal at that particular destination are removed and routed to a baggage claim area. The popularity of carrying on baggage has grown as an aid to quick exit of the aircraft and the airport by avoiding the delays often associated with retrieving baggage from a baggage claim area at the passenger's destination as well as in response to unfortunate experiences of some passengers with respect to lost or misrouted luggage.

In the United States, regulations of the Federal Aviation Administration (FAA) limit the size and number of carry on articles allowed each passenger. Thus, in the past a significant amount of work has been done in order to provide carry on luggage which can accommodate many traveler's desires to use luggage that may be conveniently and legally carried onto an airplane and stored under a seat or in an overhead storage bin.

U.S. Pat. No. 4,995,487 entitled "Wheeled Suitcase and Luggage Support", which issued to the inventor of the present invention, discloses a conveniently sized suitcase for use as carry on luggage with recessed wheels and a retractable internal handle. The suitcase disclosed in said U.S. Pat. No. 4,995,487 is a soft sided bag with a soft sided externally accessible compartment attached to the back thereof.

In the past, a number of arrangements for providing externally accessible compartments to various forms of luggage have been employed. In addition to the compartment shown in the above referenced U.S. Pat. No. 4,995,487 to Plath, soft sided luggage with externally accessible separate compartments is shown in U.S. Pat. No. 5,060,767 to Pulichino, Jr. et al. A slip over cover for a hard or soft sided case which includes a soft externally accessible pocket is shown in U.S. Pat. No. 4,729,460 to Kim.

Independently accessible hard sided compartments are shown in U.S. Pat. Nos. 2,552,438 to Kramer and 4,938,326 to Pfeiffer. Kramer shows a hard sided suitcase of essentially conventional design which has attached thereto an integral elongated hard sided segment with a hinged door, which segment is designed for carrying hanging clothes. Pfeiffer U.S. Pat. No. '326 shows a carrying case with a raised portion on one surface thereof, the raised portion being covered by a lid that is disclosed as usable for carrying interchangeable advertising material and the like.

The externally accessible compartment of the soft sided bag shown in U.S. Pat. No. 4,995,487 to Plath is convenient and useful. However, the compartment is pleated and collapsible. Therefore, materials placed within the compartment are susceptible to deformation and compression if the compartment is filled with an excessive amount of material or if it is urged too forcefully under a seat. Alternately, if other passengers place additional luggage on top of the compartment in an overhead storage area, its contents can be subject to damage.

Additionally, because it is a soft sided portion of a soft sided bag, over filling same while the main luggage compartment is substantially full can extend the depth of the luggage so that it becomes difficult to store the bag in a location having the minimum clearances used as design criteria for carry on luggage.

Externally accessible compartments are a desirable feature of luggage for the modern air traveller and a particularly desirable feature for carry on luggage. The user often will store a wallet, passport, and airplane tickets in an externally accessible compartment. Additionally, it is often desirable to keep reading materials, such as magazines and paperback books, in such a compartment so that they may be conveniently retrieved without opening a suitcase or a briefcase and read while a flight is in progress.

From the foregoing, it will be appreciated that there is a need in the art for an improved suitcase preferably of the same general dimensions of the case disclosed in U.S. Pat. No. 4,995,487 to the present inventor. It is desirable to provide one or more externally accessible compartments on such a suitcase that are sized to conveniently carry the types of materials that air travellers often want to access during flight or while changing planes at an airport without having to open the main body of the bag. It is further desirable to provide such compartments in a configuration which, even when same are filled to capacity, will not distort the dimensions of the bag that allow it to be conveniently stowed under a seat or in an overhead bin in accordance with the regulations of the United States Federal Aviation Administration and similar regulations of like agencies that regulate commercial air travel in other countries.

SUMMARY OF THE PRESENT INVENTION

The present invention provides a bag that meets the above described needs. Broadly stated, the present invention is constructed by providing a hard sided bag that has recessed wheels and a retractable handle of generally the same type as shown in U.S. Pat. No. 4,995,487. The present invention is employed in a hard sided piece of luggage. Broadly stated, it provides a unique combination of a rigid or semi-rigid material at least partly defining an enclosed volume of an externally accessible compartment with a soft sided cover covering same. This allows easy access through closure mechanisms conventionally used with soft luggage, nominally a zipper or other slide fastener, or hook and eye strips such as that sold under the trademark Velcro.

The preferred embodiment of the present invention includes both a recessed well on one semi-rigid side of hard sided luggage where the soft sided cover for the well is in the plane of the hard side of the suitcase. On the back side of the suitcase, a raised wall area is provided that defines an enclosed well, the bottom of which is preferably co-planar with the back side of the suitcase. In its most preferred form, the top of the wall defining this volume lies in a plane parallel to the back side of the suitcase, which plane is substantially tangential to the wheels of the suitcase. This serves to define a plane upon which the suitcase will stably rest when laid down on its back side.

The provision of rigid walls defining a well in the enclosed space protects the contents of the externally accessible compartment from being crushed as other suitcases or objects are placed on top of embodiments of the present invention. The combination of this with a soft sided cover provides the protection of a hard sided externally accessible compartment with the convenience of easy accessibility without the use of hinges that is normally associated with hard side luggage.

In its most preferred form, the wells partially defining the closed volumes of the externally accessible compartments are integrally formed in a mold with each side of the suitcase so that they are substantially watertight with respect to the interior of the main body of the suitcase. Thus, the external compartments can be used for stowage of objects such as wet bathing suits or containers which might possibly leak, without concern about same contaminating the contents of the interior of the main compartment of the suitcase. This is because the molded well portion fully isolates the contents of the external compartment from the contents of the main body of the suitcase. Thus, even if there is leakage within the compartment and it leaks external to the bag, it does not corrupt the user's clothing contained in the main compartment of the suitcase.

Additionally, in its preferred form, the external compartment is constructed simply by dropping a pouch into the integrally formed well and connecting same at predetermined points along a peripheral shelf within the compartment. This provides a convenient modular construction in that the pouch can be separately made and simply riveted, or otherwise secured, into place.

It is therefore an object of the present invention to provide an improved structure for a bag principally designed to be used as carry on luggage on a commercial air flight.

It is also an object of the present invention to provide a hard sided bag with external compartments defined by a rigid or semi-rigid well, which compartments are enclosed by a soft cover through which the external access is provided.

It is a further object of the present invention to provide such a suitcase where the disposition of the wells with respect to the planes of the sides upon which they are disposed serve to define planes between which the thickness of the bag is measured, said thickness being preferably selected to fit under an airline seat.

It is still a further object of the present invention to provide an improved construction for a hard sided suitcase that includes externally accessible compartments isolated from the main body of the suitcase by the material from which the hard sides are made, and having a soft covering for the externally accessible compartments through which they can be accessed by means of slide fasteners and similar devices for effecting opening and closure.

It is still a further object of the present invention to provide a piece of hard sided luggage with externally accessible compartments where the compartments are at least partially defined by a well that is integrally formed in a molding process during which one side of the suitcase is formed and which is subsequently covered by either a soft sided cover or filled with a soft sided pouch.

That the present invention meets these objects, and overcomes the drawbacks of the prior art, as well as providing an improved piece of hard sided luggage particularly suited for use as carry on luggage, will be appreciated from the detailed description of the preferred embodiment to follow.

DETAILED DESCRIPTION

Figure 2:
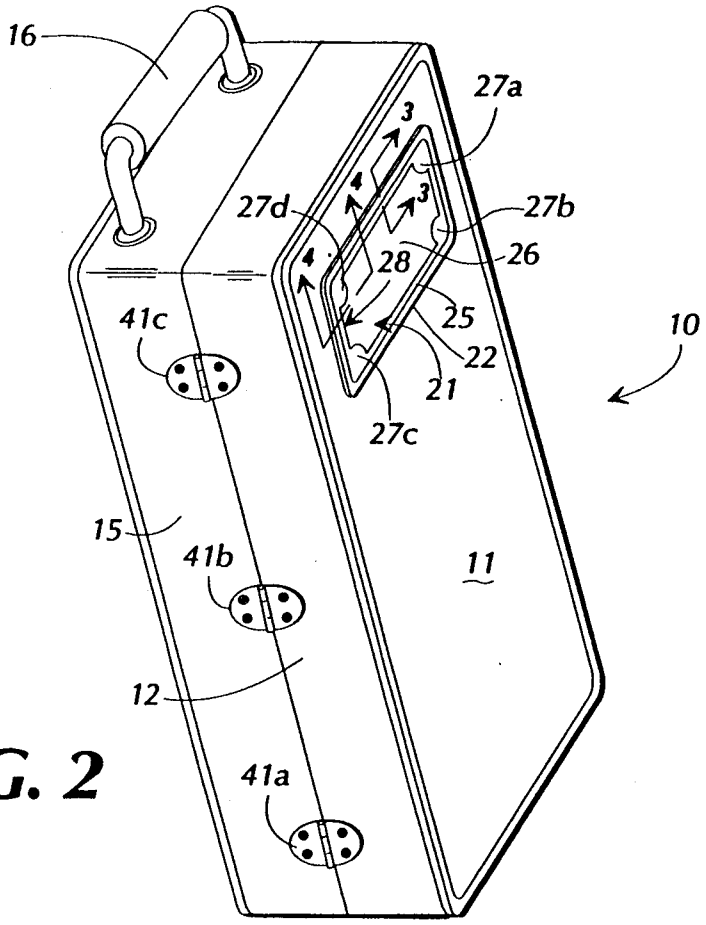
FIG. 2 is a pictorial view of the top side of the suitcase of the preferred embodiment with the soft pouch removed from the recessed compartment.

Turning now to the drawing figures in which like numerals represent like parts, the preferred embodiment of the present invention will now be described.

Figure 1:
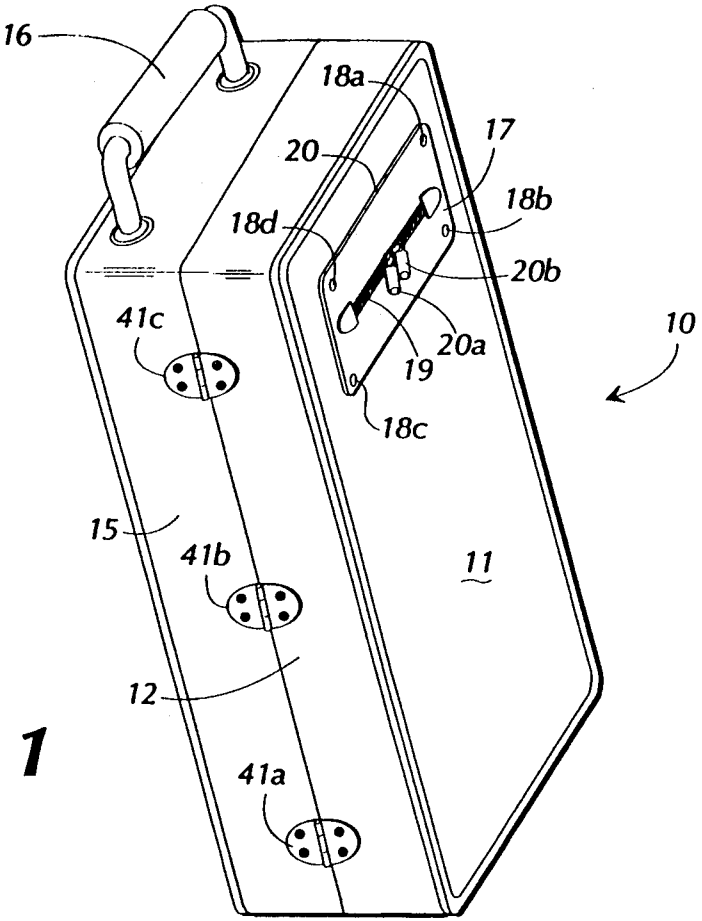
FIG. 1 is a pictorial view of the front side of the preferred embodiment of the present invention showing the recessed externally accessible compartment, as finally constructed, therein.

FIG. 1 shows a pictorial view of a suitcase 10 embodying the preferred embodiment of the present invention. FIG. 1 shows the top side 11 which forms the substantially planar upper surface of top portion 12 of the suitcase. This is joined by three hinges **41*a*–41*c* with bottom portion 15 to form a clamshell type opening. A retractable handle 16 is selectively extendable from the body of the suitcase. The mechanism for extending and receiving the handle 16** in the preferred embodiment of the present invention is of substantially the same type shown in U.S. Pat. No. 4,995,487 to Plath entitled "Wheeled Suitcase and Luggage Support", issued Feb. 26, 1991. This is a patent of the inventor of the present invention. In order to avoid unnecessary duplication of detail, said U.S. Pat. No. 4,995,487 is hereby incorporated by reference exactly as if set forth herein.

The upper surface 11 is substantially planar. It may have a slight curvature to it and still be substantially planar within the meaning of this specification. While many well known materials, including plastics and metallic materials, may be used to construct embodiments of the present invention, the preferred arrangement is to use molded sheets of ABS as the basic material for providing the semi-rigid side panels, such as top surface 11. In constructing the preferred embodiment, a sheet ABS is laid over a vacuum mold and heated. When it becomes sufficiently heated, the vacuum is applied through a large plurality of small holes on the mold and the heated sheet is sucked around the portions of the mold and molded to take the form thereof in a well known manner. Of course, stamped metal, injection molding, and other methods of fabricating a rigid or semi-rigid portion of a hard sided suitcase may be used to construct embodiments of the present invention.

A soft cover 17 of a pouch deposited in a well on the top side 11 is visible in FIG. 1. This cover, and the pouch of which it forms a part, are connected to standoffs (not shown in FIG. 1) via a plurality of rivets 18*a*–18*d*. A conventional zipper or slide fastener 19 having a pair of tabs 20*a* and 20*b* attached to the actuators thereof provides access to the interior of the compartment. As will be more fully appreciated from the discussion of the other drawing figures below, the pouch upper surface 17 is co-planar with top semi-rigid side panel 11 and the preferred embodiment. This is so that even if the compartment is substantially filled through the access provided by zipper 19 and the bag is laid on its top surface 11, there will be a minimum of crushing action since the periphery of upper semi-rigid substantially planar surface 11 protects the contents of a compartment covered by pouch upper surface 17.

As will be described in more detail in connection with FIG. 5, a pouch periphery is defined by a stiffening peripheral plastic encased wire shown at 20. This is a metallic steel wire covered with flexible plastic that forms part of a stiffening periphery to which the upper pouch surface 17 and the side edges of the pouch (see FIG. 5) are sewn in construction of the pouch.

Turning next to FIG. 2, another pictorial view of the top side 11 of the suitcase 10 of the preferred embodiment is shown with the pouch that partially defines the externally accessible compartment removed therefrom. In FIG. 2, a well indicated at 21 is defined in planar side panel 11. The well is bounded by a characteristic well periphery shown at 22 in FIG. 2. The well periphery is defined by a small vertically extending wall which goes around the entire periphery of the well. Connected to the vertical wall 22 of the well periphery is a peripheral shelf 25 which likewise extends around the periphery of the well. The bottom of the well is a planar surface 26 which is parallel to and lies below the plane of substantially planar side panel 11.

Integrally formed with peripheral shelf 25 are four standoff areas 27*a*–27*d*. In the preferred embodiment standoff areas 27 comprise a plurality of discrete locations into which rivets 18 (FIG. 1) are passed after passing through the pouch that includes upper pouch surface 17 shown in FIG. 1. A peripheral interior side wall 28 extends about the entire lower periphery of the well including the rounded portions at standoffs 27.

Figure 3:
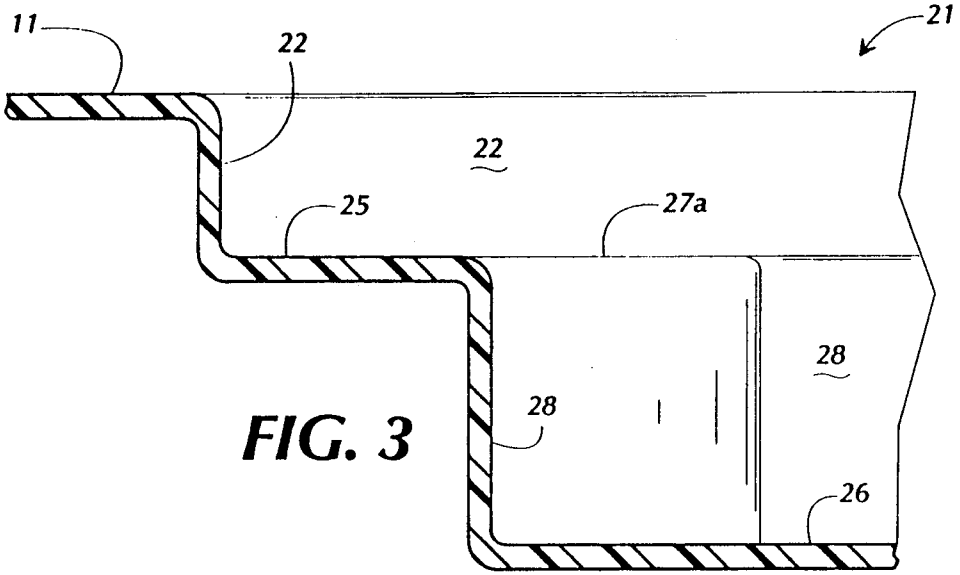
FIG. 3 is a cross section of the top side of the case taken along section line 3—3 shown in FIG. 2.
Figure 4:
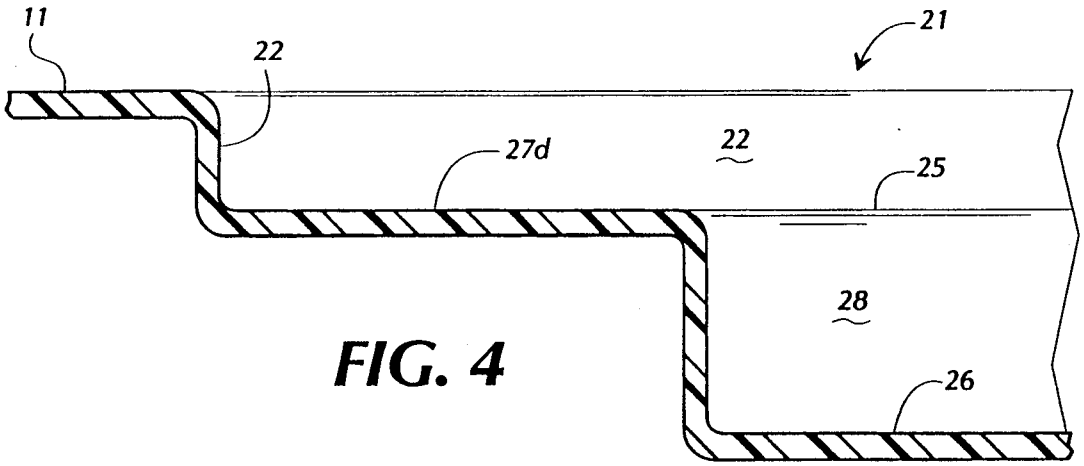
FIG. 4 is a cross section of the top side of the preferred embodiment taken along section line 4—4 shown in FIG. 2.

In order to more fully describe the geometry of the preferred embodiment of the recessed well in top side panel 11, FIGS. 3 and 4 are included which, respectively, show sections in the molded ABS upper side panel of top portion 12 of the preferred embodiment.

FIG. 3 is a cross section taken along section line 3—3 shown in FIG. 2. In FIG. 3 it can be seen that the well floor 26 is parallel to substantially planar top side panel 11. The well is indicated generally at 21. The well periphery is defined by side wall 22 which sits above peripheral shelf 25. Between peripheral shelf 25 and well floor 26 lies lower peripheral side wall 28 which extends around the rounded portion of standoff 27*a* which is visible in the view of FIG. 3. In FIG. 3 a cross section of characteristic well periphery wall 22 is shown at the left hand side and a non-section portion (i.e., that portion visible on the right hand side of FIG. 2) is shown in elevation in the view of FIG. 3.

FIG. 4 is a cross section taken along section line 4—4 shown in FIG. 2. This section cuts through standoff 27*d* and shows that the top portion of the standoffs 27 are parallel to and extensions of peripheral shelf 25. As is the case in FIG. 3, the upper side wall defining the characteristic well periphery is seen in both section and in elevation in FIG. 4, the portion visible at the top of FIG. 2 being visible in elevation in FIG. 4.

Viewing FIGS. 2–4 together, those skilled in the art will appreciate that the structure of the well formed in upper planar surface 11 is manufactureable via the molding process described hereinabove with using sheets of ABS, and that there is nothing about the geometry of the well structure of the preferred embodiment that prohibits use of a sheet molding process.

Figure 5:
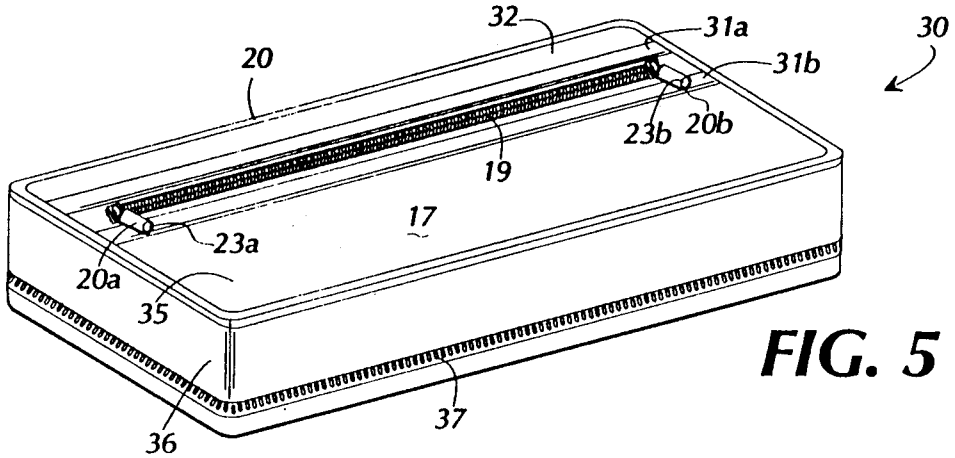
FIG. 5 is a pictorial view of the externally constructed pouch which is inserted into the recessed well as shown in FIG. 1.

In FIG. 5, a pictorial view of the assembled pouch, prior to insertion into well 21, is shown. The entire pouch is indicated generally at 30. A pair of leather strips 31*a* and 31*b* are sewn to respective portions 32 and 35 of the upper pouch surface 17. These strips are also sewn to the cloth adjacent to slide fastener 19 and thus serve to secure the slide fastener to the upper pouch surface 17 as well as provide an attractive appearance. Slide fastener 19 is of the dual actuator type having two actuators with respective tabs 20*a* and 20*b* attached thereto. Each of the tabs has a respective hole 23*a* and 23*b* passing through the distal end thereof. The slide fastener is arranged so that it is closed when the two actuators are in juxtaposition. Holes 23*a* and 23*b* allow a small padlock or other securing type device to be passed through the holes in order to prevent unauthorized access to the interior of pouch 30.

A bottom portion of the pouch (not shown) is sewn to side wall 36 of the pouch at seam 37 visible in FIG. 5. The plastic encased stiffening wire shown at 20 extends about the pouch periphery. The stiffening wire serves to hold the upper pouch surface 17 stretched in a smooth plane and keeps the edges of the pouch along the pouch periphery from drawing away from the characteristic well periphery defining upper side wall 22 shown in FIGS. 2–4.

As briefly noted hereinabove, in constructing the preferred embodiment, the inventor believes the best mode of practicing the invention is to take a completely assembled pouch such as that shown in FIG. 5 and drop it into a well having the structure shown in FIGS. 2–4. The stiffening wire 20 along the periphery of pouch upper surface 17 becomes seated on peripheral shelf 25 and is urged up against the characteristic well periphery defined by upper vertical side wall 22. The stiffening provided by the plastic encased wire 20 keeps the edges of the pouch periphery from becoming separated from the well periphery defining wall 22 and thus is both functional and improves the attractive appearance of the preferred embodiment, a factor that can be important to a manufacturer's ability to sell luggage.

When the completely assembled pouch is so seated within well 21, four rivets 18 (FIG. 1) are inserted into the corners of the pouch all the way through the upper surface 17 and the lower surface (not shown) of the completed pouch, and on through standoff regions 27. Thus, while the corners of the pouch are pinched the balance of the material of the pouch can spread out and fill the volume of well 21. The preferred mechanism for securing pouch 30 within well 21 is to pass each rivet through the upper pouch surface 17, then through a thick metallic washer (not shown) inserted into the interior of the pouch. The rivet is then passed through the lower surface of the pouch and through one of the standoff areas 27 or any portion of peripheral shelf 25. Thus, it is preferred to secure pouch 30 in the interior of well 21 at a plurality of discrete locations. However, this is not necessary in order to embody the present invention and any reasonably secure mechanism for attaching the pouch, including hot melt adhesives, ultrasonic welding and the like may be used to construct embodiments of the present invention.

Since the side walls and floor of the well are also of the semi-rigid material, which gives the suitcase its hard sided characteristic, the well provides good rigid support for materials placed within pouch 30. Since it is preferably made of molded plastic such as ABS, it provides excellent segregation of the goods placed within the pouch from those in the interior of the main body of the suitcase, irrespective of how secure, waterproof, etc., the material of pouch 30 happens to be. In the preferred embodiment, the pouch is made of woven nylon. Of course, natural fiber cloth, polyester, leather, and any other suitable flexible material may be used to construct a pouch in embodiments of the present invention.

From the foregoing description it will be appreciated that the use of a completely assembled pouch 30 as the apparatus inserted into well 21 is the preferred form and constitutes what the inventor believes is the best mode of practicing the present invention. Those skilled in the art will, in view of this disclosure, quickly appreciate that the only critical aspect is that some form of cover corresponding to upper pouch surface 17 be provided as a cover over well 21. This cover should have selectively operable means for access to the interior of the well, such as zipper 19. For example, the portion of pouch 30 bounded by plastic encased stiffening wire 20 could be used as a cover. The plastic encased wire would still seat against well periphery defining wall 22 and the corners of the cover may be riveted to standoffs 27 and provide an enclosed externally accessible compartment with a soft cover and a rigid well floor and well side walls. The use of a stiffening member such as plastic encased wire, while preferred, is not essential. The periphery of a cover can be attached at a relatively large plurality of discrete locations or attached by a continuous seam to the well periphery in an embodiment of the present invention, although the disclosed apparatus constitutes the best mode known to the inventor at the time of filing this specification. Thus, embodiments of the present invention may be constructed that use only apparatus equivalent to the upper pouch surface 17 of the complete pouch 30 that is employed in the preferred embodiment.

Figure 6:
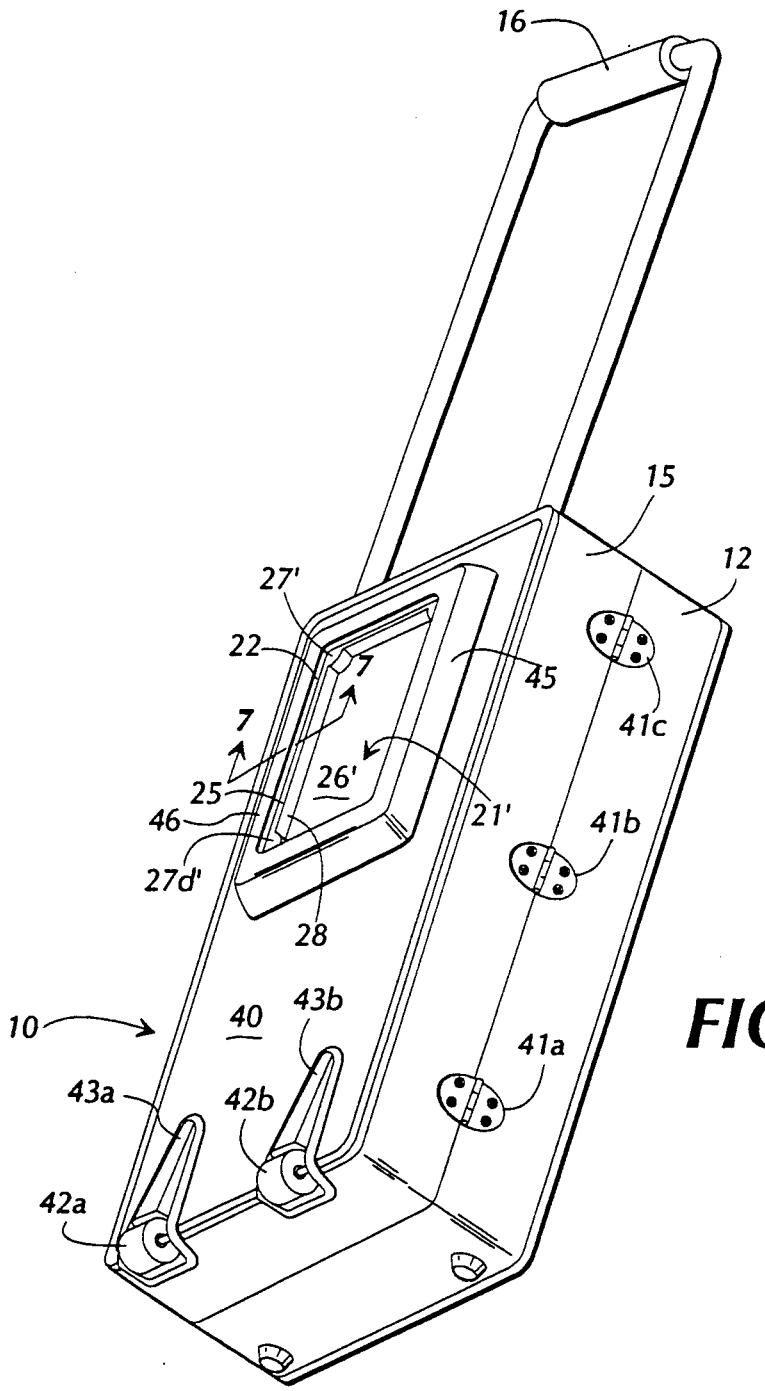
FIG. 6 is a pictorial view of the raised well on the back side of the preferred embodiment without the soft cover insert thereon.

Turning next to FIG. 6, the bottom substantially planar side panel of the suitcase of the preferred embodiment is indicated at 40. This is integrally formed as a portion of bottom portion 15 of the suitcase of the preferred embodiment. Three hinges 41*a*–41*c* pivotally connect top and bottom portions 12 and 15, respectively. In the view of FIG. 6, handle 16 is shown in its extended position. Recessed wheels 42*a* and 42*b* are shown mounted on the lower portion of the suitcase as shown in incorporated U.S. Pat. No. 4,995,487. The wheel structure used in the preferred embodiment is similar to that shown in said U.S. Pat. No. 4,995,487. In the soft sided suitcase shown in said U.S. patent, a metal plate is fitted to the bottom of the suitcase and the wheels are mounted thereon. In the preferred embodiment of the present invention, wheels 42*a* and 42*b* are formed as a part of respective caster assemblies 43*a* and 43*b* which are screwed directly onto semi-rigid side panel 40 of the bottom portion 15.

The well on semi-rigid side panel 40 of the bottom portion 15 of the suitcase of the preferred embodiment is defined by a raised wall having an exterior surface 45. The bottom of this well, indicated at 26', is co-planar with side panel 40. On top of raised wall 45 is an upper wall surface 46 which, with respect to the well, is the equivalent of top side panel 11 shown in FIGS. 2–4. The structure of the well within the bounds of upper wall surface 46 is identical to that of the well on the top side panel of the suitcase, except that it is sized differently.

Figure 7:
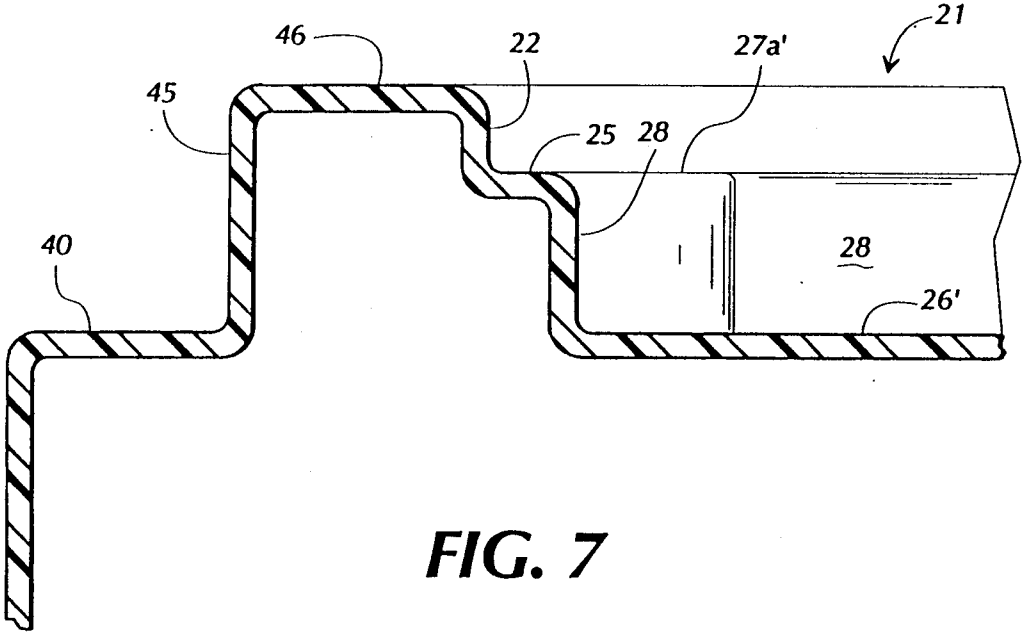
FIG. 7 is a cross section of the rear side of the suitcase taken along section line 7—7 shown in FIG. 6.

FIG. 7 shows a cross section taken along section line 7—7 shown in FIG. 6 and viewing FIGS. 6 and 7 together will lead to a quick appreciation of the similarity of structure of the two wells. The well on the bottom side panel also includes upper vertical side wall 22 defining a characteristic well periphery. It also includes a peripheral shelf 25 and standoffs indicated as 27*a'*–27*d'*. A lower vertical side wall 28 on the interior of the well is also included and is seen in both cross section and elevation in FIG. 7.

In the preferred embodiment, the dimensions of the bottom side panel well are approximately 9"×12" measured between opposite facing portions of interior side wall 28. It is preferable to size standoffs 27' so that conventional papers and magazines of 8½"×11" size or A4 size will fit within the compartment so that it may be used for magazines and other reading material that can be accessed during flight simply by unzipping the cover of the well. Other than the difference in dimensions, the structure of a pouch inserted and riveted into bottom well 21' is identical to that shown in FIG. 5, and thus does not require duplicative description thereof.

Figure 8:
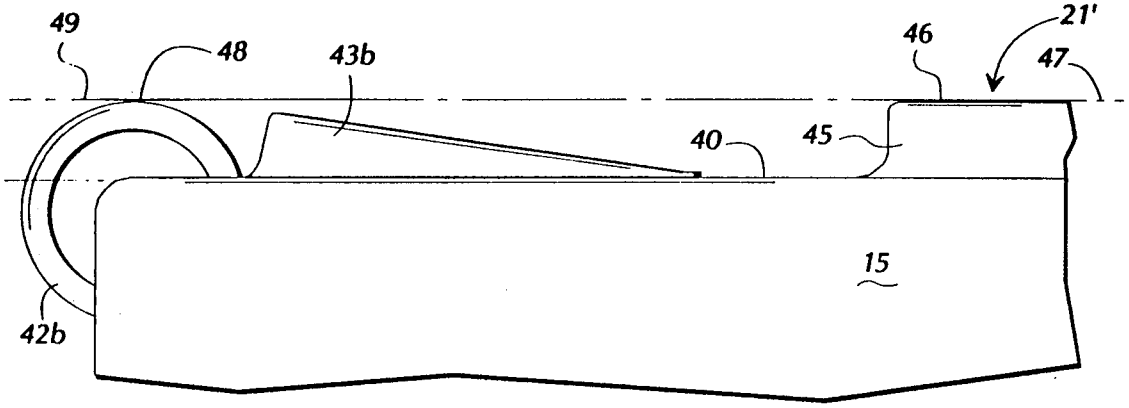
FIG. 8 is a partial side elevational view of the preferred embodiment showing the relationship of a wheel base plane to the plane of well periphery for one of the wells.

FIG. 8 shows a broken away side elevational view of a segment of bottom portion 15 of the preferred embodiment. It illustrates a desirable feature of the preferred embodiment. In FIG. 8, it can be seen that the upper wall 46 surrounding bottom well 21' defines a plane indicated at 47, which is the plane of the well periphery. A segment 48 of the arc of wheels 42*b* and 42*a* define a wheel base plane 49 that is parallel to side panel 40. In the preferred embodiment, this wheel base plane 49 is co-planar with plane 47 in which the characteristic well periphery lies. This has the effect of defining a plane in which upper wall surface 46 and wheels 42 will rest when the suitcase is laid on its bottom side on a flat surface. In the preferred embodiment, these two planes are co-planar to within a small tolerance but it is only important that they be substantially co-planar in a manner that will prevent the suitcase from doing any significant rocking about one edge of upper wall surface 46 when laid on its bottom side.

Figure 9:
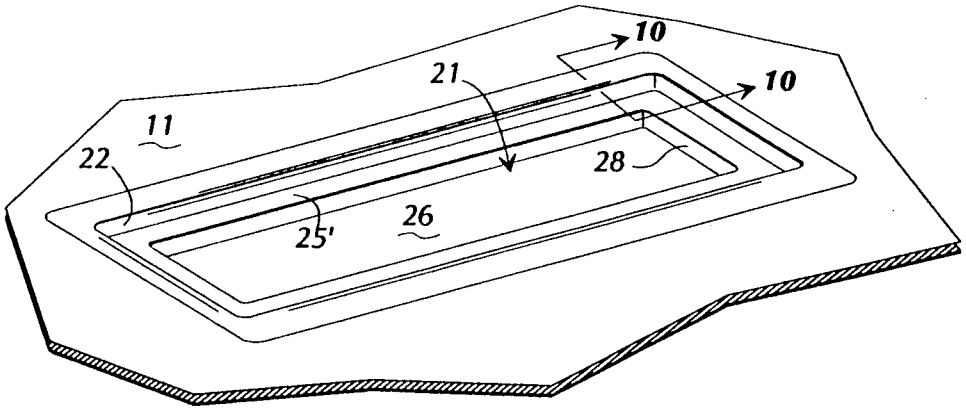
FIG. 9 is a pictorial view of an alternate embodiment of the structure for the well on the top side of the case.
Figure 10:
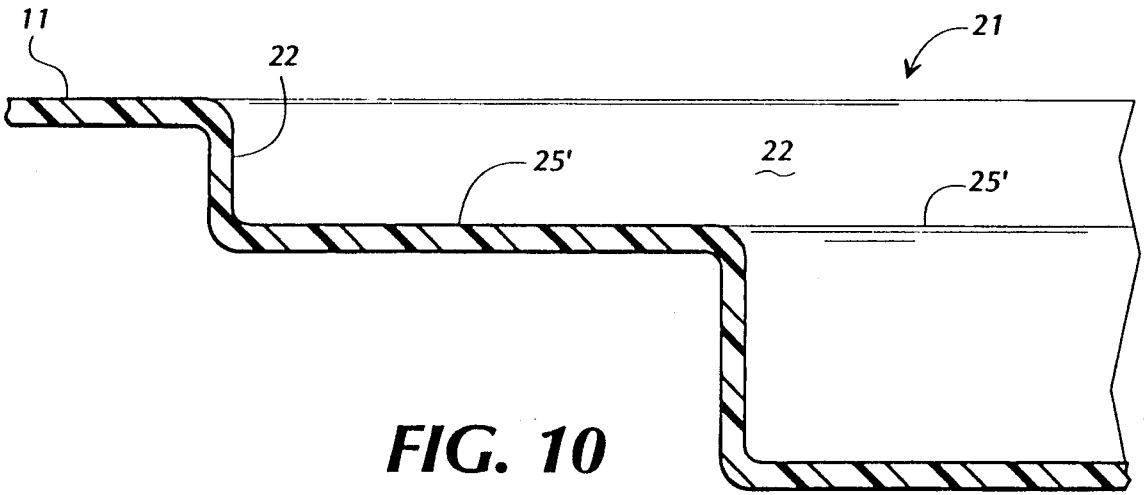
FIG. 10 is a cross section of the top side of the case taken along section line 10—10 shown in FIG. 9.

An alternate embodiment for the well construction is shown in FIGS. 9 and 10. It is shown, by example, as an alternate construction for the well on the top semi-rigid side panel 11. However, the same principles can be applied to construct raised wells for the bottom side panel 40 such as that shown in FIG. 6.

The components of the alternate construction for the well are substantially identical to those shown in FIGS. 1, 3 and 4 except that the following modifications are made. Standoff regions 27 are omitted, peripheral shelf 25 is wider than it is in the other embodiments and is located lower in the well than in the previously disclosed embodiments. This may be appreciated by viewing FIG. 10 which shows a cross section of the well taken along line 10—10 shown in FIG. 9. Contrasting FIG. 10 to the structure shown in FIGS. 3 and 4 shows that peripheral shelf 25' is wider than that in the previous embodiments and is located substantially halfway down the well. This structure has been found to be simpler to mold than that which includes standoff regions and allows design changes in the pouch which may require additional rivets or other fasteners without requiring mold changes to provide additional standoff regions.

From the foregoing description of the preferred embodiment, it will be appreciated that the preferred arrangement of the present invention is one in which the peripheral shelf 25 associated with wells 21 and 21' lies near the upper surface of the wall defining the well, i.e., side panel 11 for the recessed well and upper wall surface 46 for the raised well. However, embodiments of the present invention can be constructed wherein the peripheral shelf or an equivalent structure is located so that upper pouch surface 17 lies below the corresponding hard surface that protects it. In other words, it is preferable for these two surfaces to be substantially co-planar but as long as the upper surface of the pouch lies at or below the plane of the protective hard periphery which surrounds the well, both the pouch periphery and the pouch cover will be adequately protected as the suitcase lays on the well, and may be dragged or pushed along a floor.

The foregoing description of the preferred embodiment shows that the present invention meets its above stated objects and overcomes the drawbacks of the prior art cited hereinabove. In particular, the present invention provides the first practical hard sided luggage with rigid or semi-rigid well structures that have a soft cover externally accessible compartment. The use of the soft cover allows non-hinged external access to the externally accessible compartments via zippers, Velcro strips, and other equivalent fasteners. Thus, the compartment can be easily accessed even in the relatively cramped quarters of a passenger airplane seat with the bag on the floor either between the user's legs or under the user's feet. There is no need to have a rigid cover which must be hinged. In view of the foregoing description of the preferred embodiment, other embodiments of the present invention will suggest themselves to those skilled in the art and therefore, the scope of the present invention is to be limited only by the claims below.

What is claimed is:

1. In a suitcase of the type having at least one semi-rigid, substantially planar side panel, the improvement comprising:

means defining a well in said planar side panel, said well extending toward the interior of said suitcase and having a well periphery;

a pouch having a substantially planar pouch upper surface;

means for securing said pouch within said well so that said pouch upper surface is substantially co-planar with said side panel and substantially coextensive with said well periphery; and means disposed on said pouch upper surface for selectively providing access to the interior of said pouch.

2. The improvement of claim 1 wherein:

said planar pouch upper surface defines a pouch periphery said means defining a well in said planar side panel further define a peripheral shelf along said well periphery; and said means for securing said pouch within said well includes means attaching said pouch periphery to said peripheral shelf.

3. The improvement of claim 2 wherein:

said pouch periphery is attached to said peripheral shelf at a predetermined number of discrete locations along said peripheral shelf.

4. The improvement of claim 2 wherein:

said pouch periphery includes stiffening means for rendering said pouch periphery semi-rigid and causing said pouch periphery to be seated along said peripheral shelf.

5. The improvement of claim 3 wherein:

said pouch periphery includes stiffening means for rendering said said pouch periphery semi-rigid and causing said pouch periphery to be seated along said peripheral shelf.

6. The improvement of claim 3 wherein:

said peripheral shelf includes an extended stand-off region at each of said predetermined number of discrete locations.

7. The improvement of claim 2 wherein:

said means attaching said pouch periphery to said peripheral shelf includes a plurality of rivets.

8. The improvement of claim 4 wherein:

said stiffening means comprises a plastic covered closed loop of metallic wire secured to said pouch periphery.

9. The improvement of claim 5 wherein:

said stiffening means comprises a plastic covered closed loop of metallic wire secured to said pouch periphery.

10. The improvement of claim 1 wherein:

said means for selectively providing access to the interior of said pouch comprises a slide fastener.

11. In a suitcase of the type having at least one semi-rigid, substantially planar side panel, the improvement comprising:

means defining a well in said planar side panel, said well extending toward the interior of said suitcase and having a well periphery;

a pouch having a substantially planar pouch upper surface;

means for securing said pouch within said well so that said pouch upper surface is substantially parallel to said side panel and lies within an area consisting of a plane defined by said substantially planar side panel and the periphery of the well; and means disposed on said pouch upper surface for selectively providing access to the interior of said pouch.

12. The improvement of claim 11 wherein:

said means for selectively providing access to the interior of said pouch comprises a slide fastener.

13. In a suitcase of the type having at least one semi-rigid, substantially planar side panel, the improvement comprising:

means defining a well in said planar side panel, said well extending toward the interior of said suitcase and having a well periphery;

a cover that is substantially co-planar with said side panel and substantially coextensive with said well periphery, said cover at least partially defining an enclosed volume within said well;

means for securing said cover along said well periphery;

means defining an opening on said cover; and means for selectively providing access through said opening to said enclosed volume.

14. The improvement of claim 13 wherein:

said means for selectively providing access to said enclosed volume comprises a slide fastener.

15. The improvement of claim 13 wherein:

said cover has a cover periphery said means defining a well in said planar side panel further define a peripheral shelf along said well periphery; and said means for securing said cover over said well includes means attaching said cover periphery to said peripheral shelf.

16. The improvement of claim 15 wherein:

said cover periphery is attached to said peripheral shelf at a predetermined number of discrete locations along said peripheral shelf.

17. In a suitcase of the type having at least one semi-rigid, substantially planar side panel, the improvement comprising:

means defining a well in said planar side panel, said well extending toward the interior of said suitcase and having a well periphery;

a cover that is substantially parallel to said side panel and lies within an area consisting of a plane defined by said substantially planar side panel and an area substantially coextensive with said well periphery, said cover at least partially defining an enclosed volume within said well;

means for securing said cover along said well periphery;

means defining an opening on said cover; and means for selectively providing access through said opening to said enclosed volume.

18. The improvement of claim 17 wherein:

said means for selectively providing access to said enclosed volume comprises a slide fastener.

19. In a suitcase of the type having at least one semi-rigid, substantially planar side panel, the improvement comprising:

a well defined in said planar side panel, said well extending toward the interior of said suitcase and having a well periphery;

a pouch having a substantially planar pouch upper surface;

means for securing said pouch within said well so that said pouch upper surface is substantially co-planar with said side panel and substantially coextensive with said well periphery;

means for defining an opening on said upper pouch surface; and means for selectively closing said opening.

20. In a suitcase of the type having at least one semi-rigid, substantially planar side panel, the improvement comprising:

wall means defining a well on said planar side panel, said well extending above said planar side panel and having a well periphery;

a pouch having a substantially planar pouch upper surface;

means for securing said pouch within said well so that said pouch upper surface is substantially co-planar with the top of said well and substantially coextensive with said well periphery; and means disposed on said pouch upper surface for selectively providing access to the interior of said pouch.

21. The improvement of claim 20 wherein:

said wall means and said planar side panel are integrally formed from a single piece of material.

22. The improvement of claim 20 wherein:

said planar pouch upper surface defines a pouch periphery said wall means further define a peripheral shelf along said well periphery; and said means for securing said pouch within said well includes means attaching said pouch periphery to said peripheral shelf.

23. The improvement of claim 22 wherein:

said pouch periphery is attached to said peripheral shelf at a predetermined number of discrete locations along said peripheral shelf.

24. The improvement of claim 22 wherein:

said pouch periphery includes stiffening means for rendering said said pouch periphery semi-rigid and causing said pouch periphery to be seated along said peripheral shelf.

25. The improvement of claim 23 wherein:

said pouch periphery includes stiffening means for rendering said said pouch periphery semi-rigid and causing said pouch periphery to be seated along said peripheral shelf.

26. The improvement of claim 23 wherein:

said peripheral shelf includes an extended stand-off region at each of said predetermined number of discrete locations.

27. The improvement of claim 22 wherein:

said means attaching said pouch periphery to said peripheral shelf includes a plurality of rivets.

28. The improvement of claim 24 wherein:

said stiffening means comprises a plastic covered closed loop of metallic wire secured to said pouch periphery.

29. The improvement of claim 25 wherein:

said stiffening means comprises a plastic covered closed loop of metallic wire secured to said pouch periphery.

30. The improvement of claim 20 wherein:

said means for selectively providing access to the interior of said pouch comprises a slide fastener.

31. In a suitcase of the type having at least one semi-rigid, substantially planar side panel and a plurality of wheels disposed in said substantially planar side panel with at least a portion of the arc of each of said wheels extending above said substantially planar side panel to form a wheel base plane that is substantially parallel to said planar side panel, the improvement comprising:

wall means defining a well on said planar side panel, said well extending above said planar side panel and having a well periphery that is co-planar with said wheel base plane;

a pouch having a substantially planar pouch upper surface;

means for securing said pouch within said well so that said pouch upper surface is substantially co-planar with the top of said well and substantially coextensive with said well periphery; and means disposed on said pouch upper surface for selectively providing access to the interior of said pouch.

32. In a suitcase of the type having at least one semi-rigid, substantially planar side panel, the improvement comprising:

means defining a well on said planar side panel, said well having a well periphery, and further defining a peripheral shelf along said well periphery;

a pouch having a substantially planar pouch upper surface with a predetermined pouch periphery;

means for securing said pouch within said well so that said upper pouch surface is substantially co-planar with the top of said well and substantially coextensive with said well periphery; and means disposed on said pouch upper surface for selectively providing access to the interior of said pouch.

33. The improvement of claim 32 wherein:

said means for securing said pouch within said well includes means attaching said pouch periphery to said peripheral shelf.

34. The improvement of claim 33 wherein:

said pouch periphery is attached to said peripheral shelf at a predetermined number of discrete locations along said peripheral shelf.

35. The improvement of claim 33 wherein:

said pouch periphery includes stiffening means for rendering said said pouch periphery semi-rigid and causing said pouch periphery to be seated along said peripheral shelf.

36. The improvement of claim 33 wherein:

said peripheral shelf includes an extended stand-off region at each of said predetermined number of discrete locations.

37. The improvement of claim 35 wherein:

said stiffening means comprises a plastic covered closed loop of metallic wire secured to said pouch periphery.

38. In a suitcase of the type having at least one semi-rigid, substantially planar side panel, the improvement to said side panel comprising in combination:

a semi-rigid peripheral side wall portion, said side wall portion defining a substantially planar upper wall surface and defining an interior well periphery;

a recessed well portion surrounded by said peripheral side wall portion and peripherally bounded by said well periphery;

a cover extending at least to said well periphery, said cover at least partially defining an enclosed volume within said well;

means for securing said cover along the periphery of said well;

means defining an opening on said cover; and means for selectively providing access through said opening to said enclosed volume.

39. The improvement of claim 38 wherein:

said recessed well portion, said semi-rigid peripheral side wall portion and said planar side panel are integrally formed from a single piece of material.

40. The improvement of claim 38 wherein:

said cover comprises an upper surface of a pouch and defines a pouch periphery side wall portion further defines a peripheral shelf along said interior well periphery; and said means for securing said cover includes means for attaching said pouch periphery to said peripheral shelf.

41. The improvement of claim 40 wherein:

said pouch periphery is attached to said peripheral shelf at a predetermined number of discrete locations along said peripheral shelf.

42. The improvement of claim 40 wherein:

said pouch periphery includes stiffening means for rendering said said pouch periphery semi-rigid and causing said pouch periphery to be seated along said peripheral shelf.

43. The improvement of claim 41 wherein:

said peripheral shelf includes an extended stand-off region at each of said predetermined number of discrete locations.

44. The improvement of claim 40 wherein:

said means attaching said pouch periphery to said peripheral shelf includes a plurality of rivets.

45. The improvement of claim 42 wherein:

said stiffening means comprises a plastic covered closed loop of metallic wire secured to said pouch periphery.

46. The improvement of claim 38 wherein:

said recessed well portion defines a well floor plane and said well floor plane lies below said planar side panel.

47. The improvement of claim 38 wherein:

said recessed well portion defines a well floor plane and said well floor plane is substantially co-planar with said planar side panel.

* * * * *